United States Patent [19]

McCarthy

[11] 4,190,052

[45] Feb. 26, 1980

[54] STEAM FACIAL APPARATUS

[75] Inventor: Edward F. McCarthy, Medford, Mass.

[73] Assignee: The Gillette Company, Boston, Mass.

[21] Appl. No.: 970,748

[22] Filed: Dec. 18, 1978

[51] Int. Cl.[2] ..... A61H 33/00

[52] U.S. Cl. ..... 128/368

[58] Field of Search ..... 128/362, 367, 368, 173.2, 128/192, 193, 66, 24.1; 219/271, 40, 222

[56] References Cited

U.S. PATENT DOCUMENTS

| | | | |
|---|---|---|---|
| 1,998,327 | 4/1935 | McGuire | 128/192 |
| 2,046,633 | 7/1936 | Johnson | 128/192 |
| 2,267,547 | 12/1941 | Zimmerman | 128/256 |
| 2,368,115 | 1/1945 | Chapple | 219/40 |
| 3,351,737 | 11/1967 | Kathman et al. | 219/271 |
| 3,453,969 | 7/1969 | Mattingly | 128/66 |
| 3,493,722 | 2/1970 | Popeil | 219/222 |
| 3,511,236 | 5/1970 | Conlin et al. | 128/187 |
| 3,645,007 | 2/1972 | Scott | 34/60 |
| 3,749,092 | 7/1973 | Williams | 128/356 |
| 3,768,483 | 10/1973 | Kusunoki | 128/368 |

FOREIGN PATENT DOCUMENTS

| | | | |
|---|---|---|---|
| 947178 | 5/1974 | Canada | 128/368 |

*Primary Examiner*—Lawrence W. Trapp

*Attorney, Agent, or Firm*—Richard A. Wise; Raymond J. De Vellis

[57] ABSTRACT

A mixture of air and steam is provided for facial treatment through a flexible hose at a temperature range controlled by the effective size of air vents. The interior of the apparatus as well as that of a boiler located in the housing is pressurized when a fan is activated. A one-way valve associated with the boiler permits fluid communication to the interior of the boiler only when the pressure or steam in the boiler is not sufficient to block incoming fluid.

12 Claims, 9 Drawing Figures

STEAM FACIAL APPARATUS

BACKGROUND OF THE INVENTION

The present invention relates to skin treatment apparatus of the type which provides water mist or vapor such as steam to the skin.

More particularly, the present invention relates to a facial sauna product which provides a cost-effective, easy-to-manufacture vaporizer using a non-electric temperature control system. The product will include overfill protection whether the unit is operating or not operating.

In the past, vaporizers and the like employed a variety of temperature control schemes. Examples include the mechanically controlling of the amount of input air, as disclosed in U.S. Pat. No. 3,511,236, or electrically controlling the fan/motor assembly as disclosed in U.S. Pat. No. 3,749,092 to provide a temperature range for steam to be applied to an area of the skin such as the face. Units which deliver steam and permit the user to fill the steam chamber when the steam chamber is pressurized and/or includes steam may be dangerous to the user. Thus, configurations which may allow the consumer to access the steam chamber, such as for refill while the unit is activated should be avoided. Further, steam units should be designed in a manner which provides overfill protection both when the unit is activated and when the unit is not activated. This is especially important when a compact design necessitates the use of a relatively small boiler which must maintain sufficient free head space to operate efficiently.

Briefly stated and according to an embodiment of this invention, the problems with the prior art devices have been overcome by the practice of this invention which include a steam chamber or boiler having in its associated fill means a one-way valve, such as an umbrella valve, which permits water to enter the boiler only when there is not sufficient steam or pressure in the boiler. The associated valve not only prevents the introduction of water into the boiler when the blower or fan is activated causing a pressure increase in the boiler but also prevents steam from escaping from the fill well due to the valve's one-way action. Overfill protection for the boiler, when the unit is "off," is provided by a drain communicating between the exterior of the housing and the interior of the boiler. The drain tube will be pinched off, or the like, when the unit is activated in an automatic manner such as by being mechanically linked to the start or "on" position of the associated control knob which also controls the effective area of the input vents to provide temperature control.

SUMMARY OF THE INVENTION

It is therefore an object of this invention to provide a safe, compact, easy-to-manufacture steam facial product suitable for consumer use.

It is a further object of this invention to provide a steam facial product which protects the user from hazards associated with filling a steam boiler chamber.

It is a further object of this invention to provide a steam facial device which includes the functions of an on/off switch, temperature adjustment, and overfill protection.

The invention both as to its organization and principle of operation, together with further objects and advantages thereof, may better be understood by reference to the following detailed description of an embodiment of the invention taken in conjunction with an accompanying drawing in which:

DETAILED DESCRIPTION OF THE PREFERRED EMBODIMENT

Figure 1:
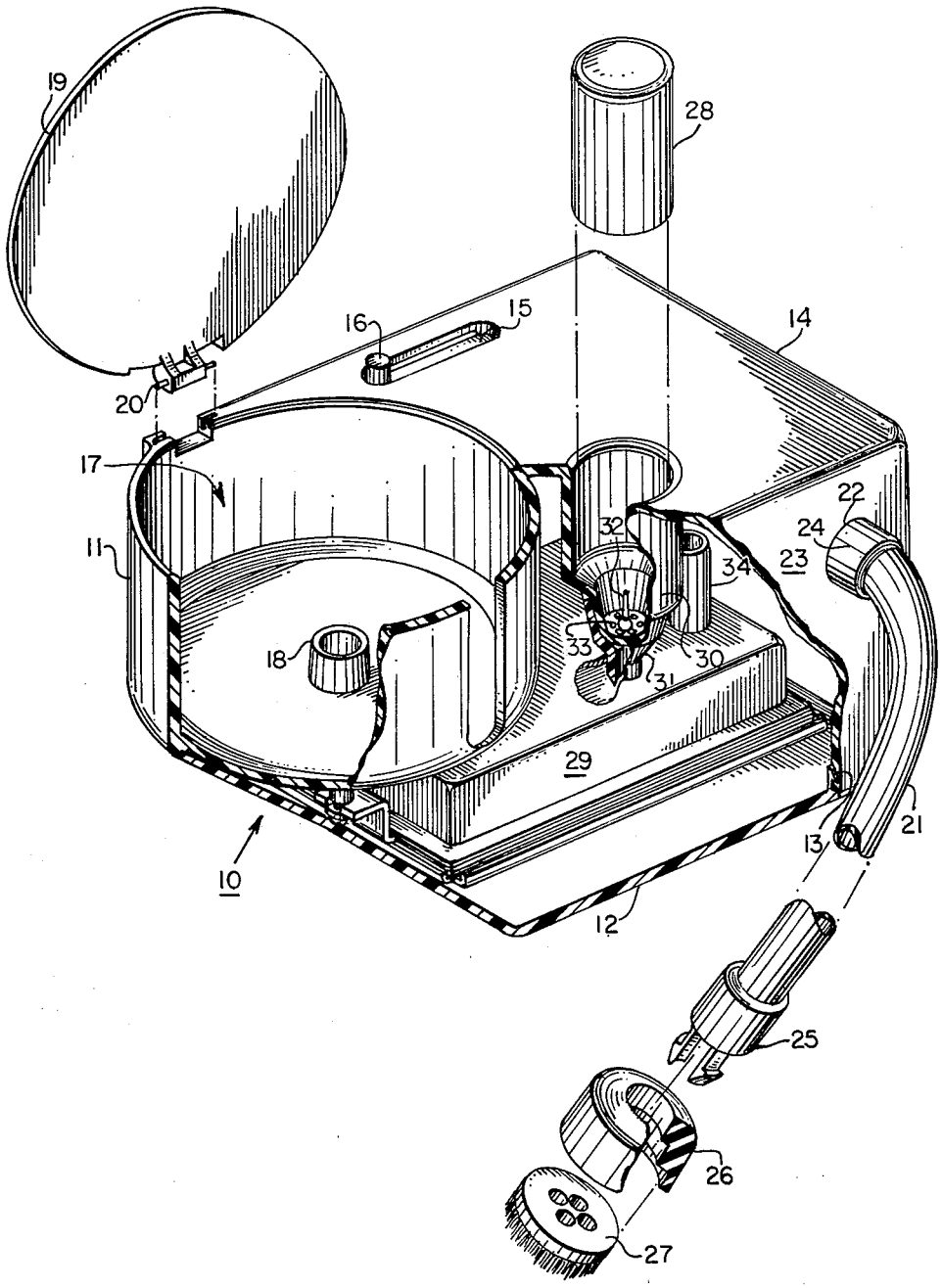
FIG. 1 is a perspective view of the steam facial apparatus in accordance with this invention.

Referring now to the drawings where the same reference number will designate like parts, the steam facial apparatus or facial sauna unit 10 of FIG. 1 is comprised of an upper portion or housing 11 used to mount various components of the facial sauna unit 10 and lower portion or base 12. The housing 11 and base 12 are both preferably constructed of a plastic such as polystyrene and are interconnected by means of snap fingers such as detent 13 in a manner well known in the art. The top surface 14 of the housing 11 defines a longitudinal opening or slot 15 through which a control knob 16 is disposed. Also integrally formed in the housing 11 is a generally cylindrical storage well 17 which may be used to store a flexible hose and attachment to be described subsequently by winding the hose about a centering member 18 located on the bottom of the storage well 17. The storage well 17 may be closed in any well known manner such as by cover 19 and may include a storage compartment, a mirror or the like (not shown). The cover 19 is attached to the housing 11 of the facial sauna unit 10 by means of a hinge member 20 or other well known fastening means such as a living hinge.

When in use, the hose 21 is coupled to a steam exhaust or outlet 22 in the front wall 23 of the facial sauna unit 10 by means of a snap fit coupling member such as hose coupler 24 or other well known, easily releasable fastening means. The hose is preferably about thirty inches in length and has an inside diameter of approximately one half inch. In a preferred embodiment the hose is comprised of a wire reinforced PVC double jacket to provide both structural integrity ans sufficient flexibility. The working end of the hose 21 includes attachment holder means such as coupling members 25 and 26 for releasably securing a personal care attachment such as skin brush 27. Coupling members 25 and 26 may be of a one-piece design and may also include an integrally formed attachment, all as well known in the art.

Shown in exploded view in FIG. 1 is a generally cupshaped hollow fill cap 28 which when turned in the proper orientation is a pre-measured container for water or the like having a volume such as twenty five cc. The water is poured through a fill means into boiler 29. The fill means includes a fill well 30 disposed in a fill funnel 31.

Figure 8:
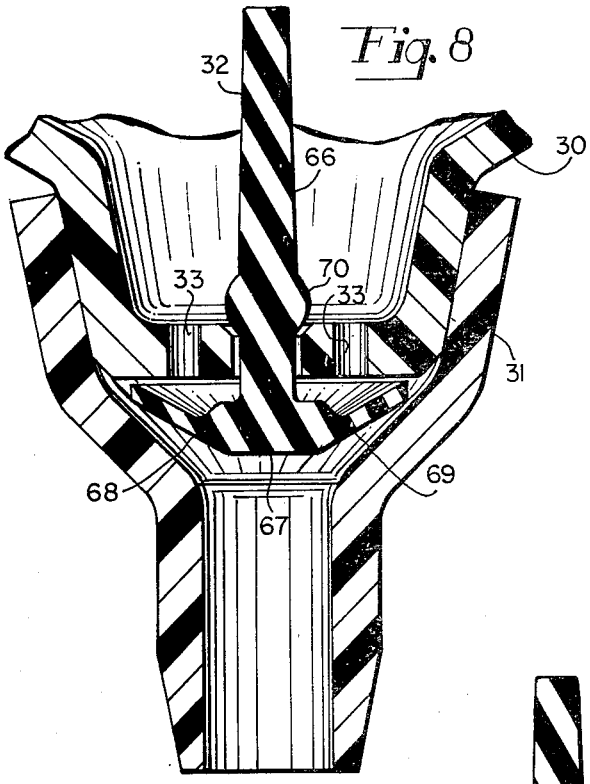
FIG. 8 is a cross-sectional view, partial in section, of an umbrella valve disposed in its associated fill means in an open position in accordance with this invention.
Figure 9:
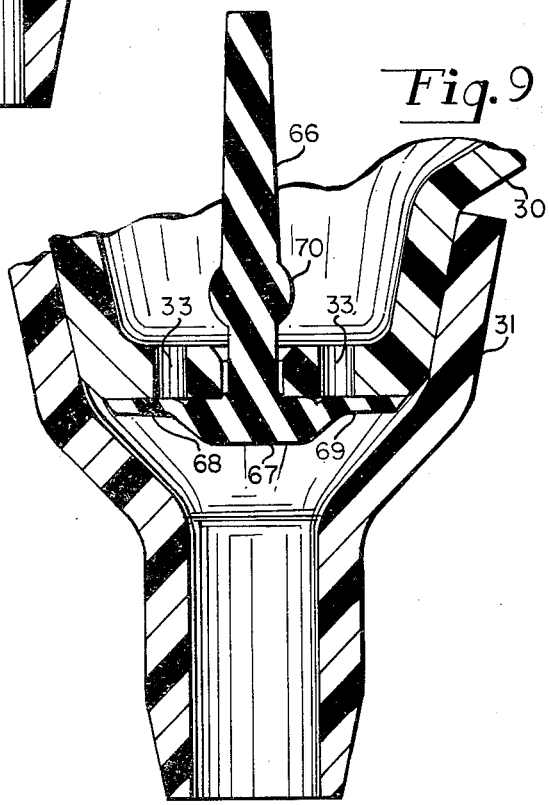
FIG. 9 is a cross-sectional view, partial in section, of an umbrella valve disposed in its associated fill means in a closed position in accordance with this invention.

Fill well 30 and fill funnel 31 may be separately formed as shown in FIGS. 8 and 9 or may be integrally formed as a one-piece assembly of any suitable material such as plastic. Disposed between the bottom of the fill well 30 and the fill funnel 31 is a one-way valve such as umbrella valve 32. Of course, if the fill well 30 and fill funnel 31 were integrally formed, a lip or the like would be used in place of the bottom of the fill well 31 to receive the umbrella valve. This lip or the bottom of the fill well 31 would also include a plurality of apertures, such as aperture 33 which provide fluid communication from the fill well into the boiler when the umbrella valve 32 is in its open position as shown in FIG. 8.

The boiler 29 is preferably formed of a heat conductive material such as aluminum and has a volume such as about two hundred cc. The boiler 29 has more capacity than the charge of the fill in order to provide the necessary free head space to lessen the chance of the liquid in the boiler 29 perculating. The boiler 29 also includes a steam exit means such as an opening in the top surface of the boiler 29 or standpipe 34. When the water in the boiler 29 reaches an appropriate temperature, the generated steam will pass through standpipe 34 into the pressurized interior of the unit 10, and flow as shown by the direction of the arrows of FIG. 4 through outlet 22 and hose 21.

Figure 2:
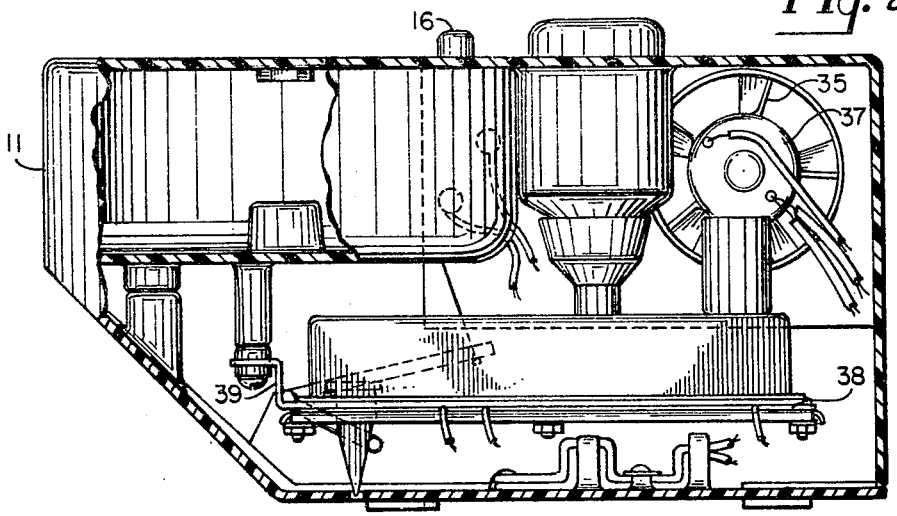
FIG. 2 is a front elevational view partial in section of the steam facial apparatus in accordance with this invention.
Figure 3:
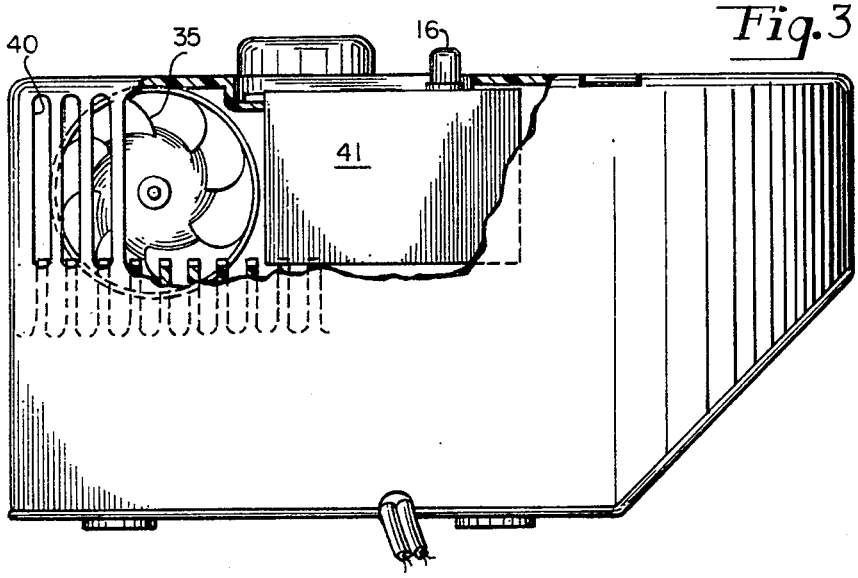
FIG. 3 is a rear elevational view partial in section of the steam facial apparatus in accordance with this invention.

FIGS. 2 and 3 illustrate the position of an air mover such as an axial fan/motor assembly. The fan assembly includes a fixed vane axial fan 35 which may include its stator integrally formed on a plenum wall 36 shown in FIG. 6. The motor 37 which drives the fan 35 in a manner well known in the art may be a DC permanent magnet motor or the like. Note that the motor 37 in a preferred embodiment of this invention always runs at the same speed and all variations in the output steam air temperature are controlled by the relative amount of air mixed with the steam as controlled by the effective air input area.

As shown in FIG. 2, a heater assembly 38 is illustrated as being proximate to the bottom of the boiler 29. The heater assembly 38 is mounted to the housing 11 of the facial sauna unit 10 through mounting member 39.

FIG. 3 illustrates a plurality of parallel longitudinal air input vents such as vent 40 which act as the air inlet to the facial sauna unit 10. The fan 35 is disposed behind the vents for drawing air into the interior of the unit 10 and creating a pressure increase therein. Preferably the vents are eight or ten in number and, depending upon the number of vents in air communication with the interior of unit 10 controlled by the position of shutter or air control door 41 positionable by control knob 16, the temperature at the outlet of the unit is controlled within a predetermined range in a manner to be described later.

The heater assembly 38 is comprised of a nichrome wire wound in a manner well known in the art and includes in its assembly an associated thermostat and thermal link.

Figure 4:
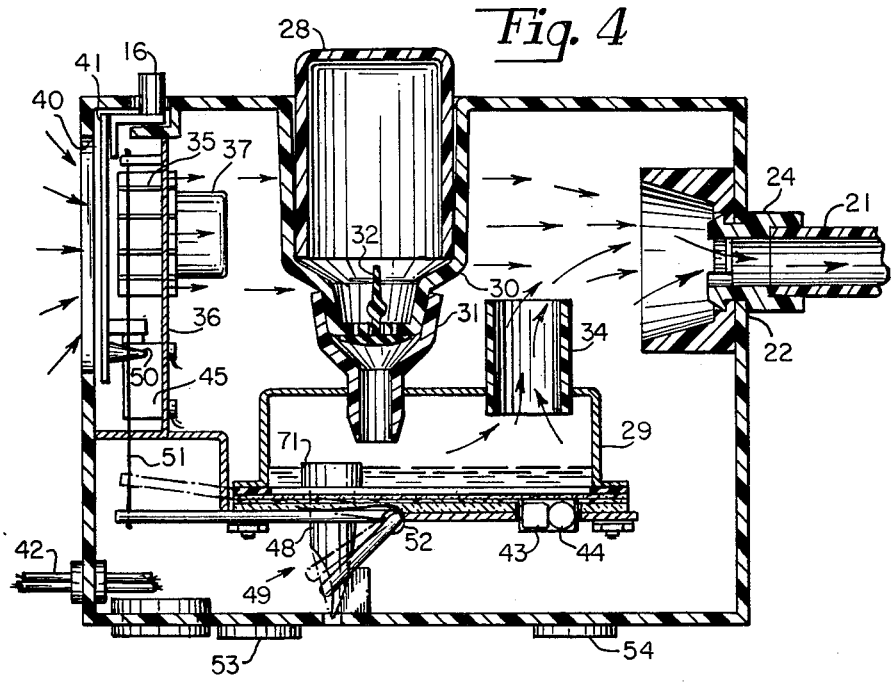
FIG. 4 is a diagrammatical representation of the steam facial apparatus in accordance with this invention.

Referring now to FIG. 4, the facial sauna unit 10 with its fan 35 and motor 37 is powered through an AC power cord 42. Integral with the heater assembly 38 on the bottom of the boiler 29 is thermostat 43 and thermal link 44. The thermostat 43 interrupts the current when a predetermined temperature is realized and later resets itself when the temperature subsides. The thermostat 43 is in a preferred embodiment an open frame thermostat with a bi-metal movable arm. The thermal link 44 is well known in the art and is set to actuate at a predetermined temperature. Hose 21 is shown connected through coupler 24 to the unit 10. The arrows in FIG. 4 indicate the direction of the air flow through the vents such as vent 40 which are exposed to the interior of the facial unit 10 depending upon the positioning of air control door 41 controlled by positioning knob 16. The air is drawn into the unit by the fan 35 powered by the motor 37 mounted on the plenum wall 36 which diagrammatically also includes a power switch 45.

Figure 6:
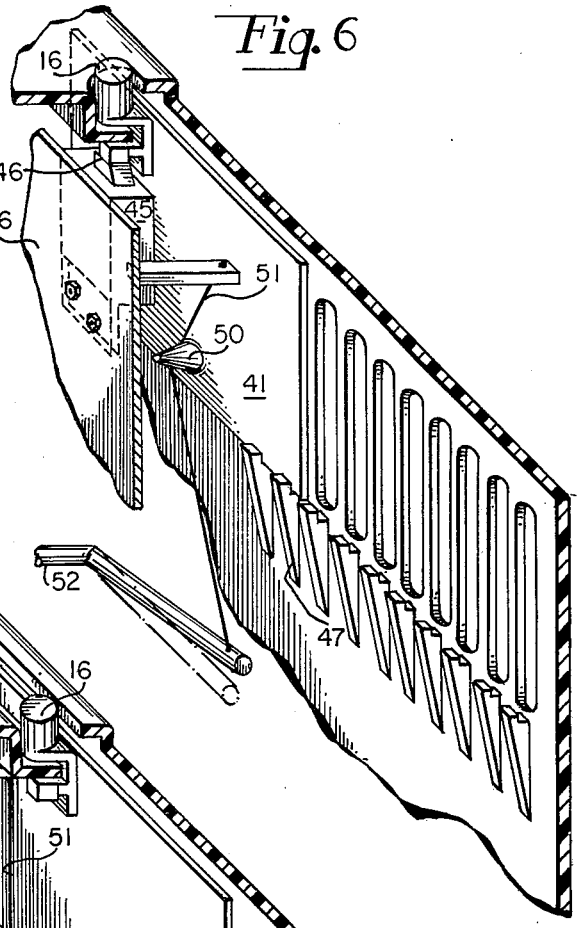
FIG. 6 is a partial view of the interior of the rear portion of the steam facial apparatus illustrated in an "off" position in accordance with this invention.

The power switch 45 may comprise a slide switch such as a normally closed, i.e. the circuit is normally activated or "on," single pole, single throw switch. The slide switch may be slide actuated and spring loaded with an actuator button, such as actuator button 46 of FIGS. 6 and 7 with a tapered front surface. The tapered front surface of the actuator button 46 when the knob 16 is in the position as shown in FIG. 6 causes the switch to be in the "off" or open position in that it is pressed down because of the force of the knob 16.

Other alternatives to the spring loaded slide switch would be a spring loaded cantilever designed switch which is also spring loaded in the normally closed position. Such a switch may have a cam surface mounted on the air control door 41 which cams the cantilevered switch open and includes a detent to lock it when in the "off" position.

Disposed through the bottom of the boiler 29 and the base 12 of the facial sauna unit 10 is a duck bill valve 48. The duck bill valve 48 has a flange portion 71 disposed in the boiler 29 of sufficient height to supply overfill protection to the unit 10 only when the level of the water or fluid in the boiler 29 is greater than the height of the flange 71. When water is of a greater depth than the height of the flange 71 of duck bill valve 48, water will communicate through the hollowed interior of the duck bill valve and exit outside the facial sauna unit providing the fluid communication pathway inside the duck bill valve 48 is not cut off by associated shut-off means such as shut-off mechanism 49. The duck bill valve 48 may be of the type manufactured by Vernay Laboratories Inc. of Yellow Springs, Ohio, and designated Catalog No. VA-3107. The material for the duck bill valve may be any elastomeric-type material capable of withstanding the appropriate temperature range. Other drain means than the duck bill valve 48 may be associated with the unit 10 such as an associated drain tube disposed in the side wall of the boiler 29 to provide overfill protection.

In any event, the drain means will provide fluid communication from the boiler to the exterior of the unit only when the control knob 16 positions the air control door 41 to the "off" position. In the "off" position, the associated shut-off mechanism 49 will not pinch the deformable neck of the drain means such as duck bill valve 48 to allow the fluid communication. Thus, if the unit is not "on," i.e. the power switch 45 is not activated and any overfill by the user of the sauna unit 10 will result in the fluid exiting through the base 12 of the facial sauna unit 10.

Once the control knob 16 positions the associated air control door 41 in a position which allows the power switch 45 to be in an "on" position, the associated shut-off mechanism 49 will pinch or otherwise deform the drain means such as duck bill valve 48 to prevent fluid communication between the boiler and the exterior of the facial sauna unit. Since the system operates in a pressurized mode, it is important to provide fluid integrity to the system during its operation and thus the drain means 48 should be pinched or closed.

Even when the unit is in the operating position, overfill protection is still provided in that once pressure builds up in the interior of the facial sauna unit 10, a pressure increase is realized in the interior of the boiler 29 through the standpipe or vent 34 and the umbrella valve 32 is sealed up against the fill well such as shown when referring to FIG. 9. This sealing occurs even prior to steam being generated by the normal heating of the fluid in the boiler 29 which, of source, will only be allowed to escape through the standpipe 34 and not through the one-way valve 32.

Figure 7:
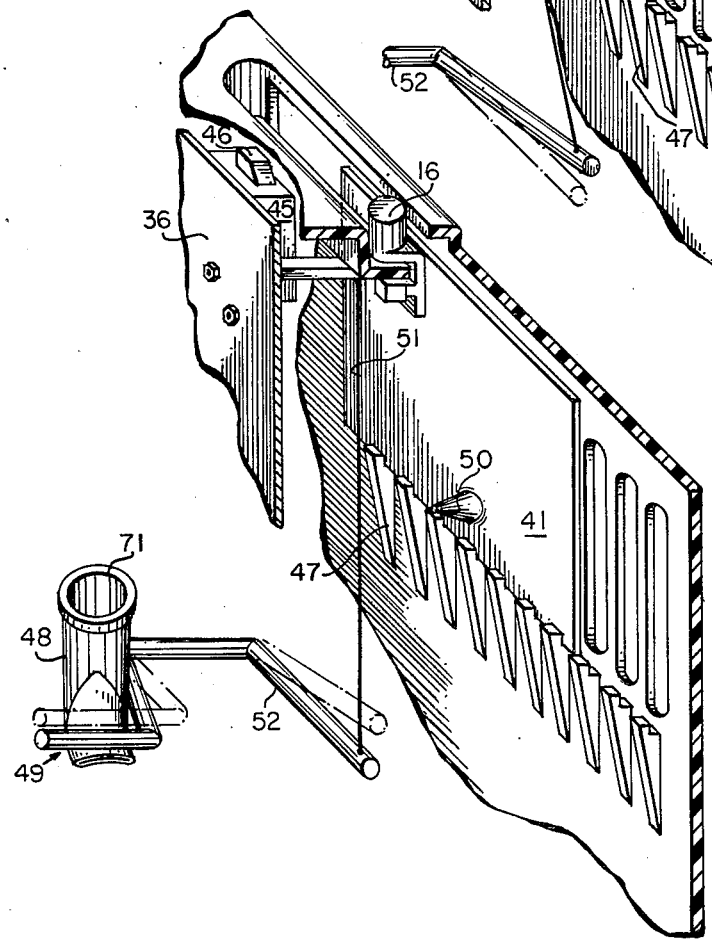
FIG. 7 is a partial view as in FIG. 6 illustrated in the maximum temperature position in accordance with this invention.

As can be best seen when referring to FIG. 6 and FIG. 7, the shut-off mechanism 49 may be accomplished in any manner well known in the art. In a preferred embodiment, this manner is accomplished by use of an integrally formed boss 50 formed on the inward side of the air control door 41. When the knob is positioned in the "off" position as shown in FIG. 6, an associated cable or wire, such as cable 51 mounted to any convenient spot on the housing 11 or plenum 36 is stressed from its normal position as shown when referring to FIG. 7, thereby causing spring/lever assembly 52, shown diagrammatically in FIG. 4, to release the lateral force on the elastomeric neck of the duck bill valve 48 and permit fluid communication between the interior of the boiler and the exterior of the facial sauna unit 10. In all other positions of the control knob 16, the force of the spring/lever arm 52 will shut or pinch off the neck portion of the duck bill valve 48 and prevent fluid communication and pressure leaks from the system.

Pads such as 53 and 54 may be positioned on the bottom surface of the base 12 of the facial sauna unit to provide ease or movement of the facial unit 10 without marring any associated surfaces.

Figure 5:
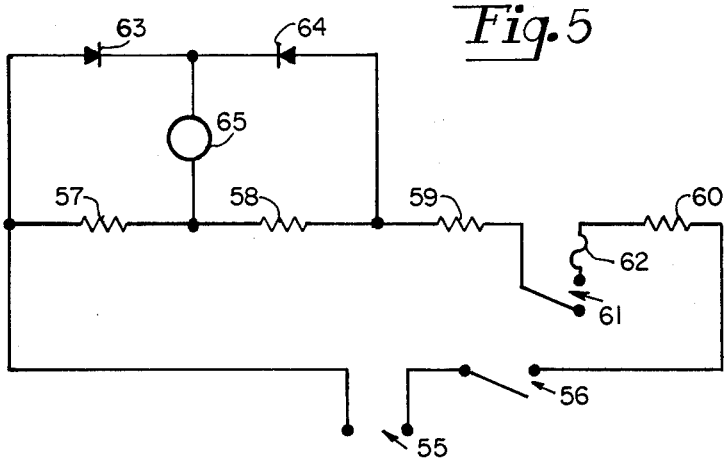
FIG. 5 is a schematic diagram for the steam facial apparatus in accordance with this invention.

Referring now to FIG. 5, power is supplied to the facial sauna unit through input means 55 when the power switch 56 is in the closed position. As explained previously, the power switch 56 in a preferred embodiment is typically a normally closed switch which is opened only when the air control door 41 is in a predetermined position.

When input means 55 receives its normal power, such as from a standard 120 volt AC 60 hertz outlet, the heater assembly comprising resistors 57, 58, 59, and 60 is activated. Typical values for resistors 57 and 58 are 14 ohms and resistors 59 and 60 are 20 ohms each. Also connected in series in the heater assembly circuit such as between resistors 59 and 60 are thermostat 61 and thermal link 62. When the circuit is activated, sufficient voltage is tapped from the heater assembly such as from resistors 57 and 58 are rectified through diodes 63 and 64 to provide a proper DC output to power DC motor/fan assembly 65, all in a manner well known in the art.

FIG. 6 illustrates the position of the air control door 41 with respect to the vents such as vent 40 in the "off" position. As illustrated in FIG. 6, integrally molded guide means 47 are used to guide the air control door 41 in a sliding relationship to the air inlet vents. Of course, other types of guide means are possible to selectively position the air control door 41 to change the effective area of the air input vents, all as well known in the art.

Referring now to FIG. 8 and FIG. 9, there is disclosed a cross-sectional view of the umbrella valve such as umbrella valve 32 in its open configuration (FIG. 8) and closed configuration (FIG. 9). The closed configuration of FIG. 9 is caused by either the build-up of steam in the boiler or prior to the steam build-up, by an increase in pressure in the boiler. In the closed configuration, fluid communication between the inside of the boiler and the fill well is substantially prevented. In its open configuration, fluid communication is possible between the contents of fill well 30 and the hollow interior of fill funnel 31 through aperatures 33. If desired, fill well 30 and fill funnel 31 may be integrally formed with a lip for retaining the valve and including a plurality of apertures for fluid communication, such as around the periphery of the lip.

State of the art one-way valves may be substituted for the umbrella valve. A valve such as that manufactured by Vernay Laboratories, Yellow Springs, Ohio, Catalog No. VA-3123, comprised of an elastomeric material capable of withstanding the appropriate temperature range is suitable.

The umbrella valve 32 is formed in a general inverted umbrella shape including a stem member 66 and a cap member 67 having elastomeric portions 68 and 69. The upper surface of the portions 68 and 69 mate with the bottom surface of the fill well 30 to prevent fluid communication by blocking off aperatures 33 included in the bottom of the fill well 30. The stem member 66 of the umbrella valve 32 also includes an integrally formed ball-like portion 70 which sits on a receiving slot formed in the top surface of the bottom of the fill well 30 to prevent the ready removal of the umbrella valve 32 and limit its travel.

In operation, the consumer fills the boiler with the fill cup. The contents of the fill cup, e.g. water, are poured into the boiler through an umbrella valve contained in the bottom of the fill well. The valve permits water to pass into the boiler but seals if steam or pressure is generated in the boiler.

Assuming that the fill of the boiler is accomplished when the steam facial apparatus is in an electrically "off" position, an associated drain coupling the boiler, at a predetermined level, to the exterior of the housing or a duck bill valve positioned through the boiler will act as an overfill. When the unit is electrically activated, i.e. plugged in and the control knob moved to release the spring loaded normally off switch, power is supplied through the power switch and the fan and heater assembly are activated at the same time. In addition, when the unit is in the "on" position, mechanical pinching means will prevent fluid communication between the boiler and exterior of the housing by pinching the associated drain or the like. Overfill protection is provided in the "on" position by an initial pressure build-up in the boiler through the steam exit vent which seals the umbrella valve toward the fill cup and, later, by the generated steam.

The heater assembly provides 200–250 watts in a low watt density (such as approximately 15 watts in.$^2$) to the bottom plate of the boiler. In a short period of time such as two minutes, steam is generated and exits the boiler through the steam exit vent into the air stream from the fan. The air stream now is mixed with the steam and is carried through a hose assembly to a personal care attachment such as a brush or pad.

When the air control door is positioned with respect to the air vent in the housing to provide a minimum effective air inlet pathway, e.g. such as two vents, a high temperature for the air/stream mixture at the face of an attachment at the far end of the hose is 50° C. A low temperature of 40° C. may be achieved with a maximum effective air inlet pathway such as an effective area of air input comprising eight vents. The air inlet area is controlled by the air control shutter which is moved by the control knob and provides the consumer with a single control which turns the unit on/off, provides overfill protection when the unit is on and off, and also provides temperature control. From the beginning of steam generating, the temperature range of 40° to 50° C. can be maintained for about 5 to 7 minutes.

Upon depletion of the water in the boiler, a thermostat operates to remove all power from the unit. If the consumer fails to move the control knob to actuate the power switch, the unit will "dry cycle" in a few minutes, and the fan will provide an audible indication of the "power on" condition. The thermostat/fusible link combination will protect the unit indefinitely during "dry cycling."

While an embodiment and application of this invention has been shown and described, it will be apparent to those skilled in the art that many more modifications will be possible without departing from the inventive concepts herein described.

What is claimed as new and desired to be secured by Letters Patent of the United States is:

1. A facial treatment apparatus comprising housing means including a plurality of air vents and a steam exit means;

steam generator means positioned in said housing means and including a heater assembly and a boiler for generating steam, said boiler including a steam exit means for releasing steam from said boiler for combination with air in said housing to said steam exit means;

air moving means positioned in said housing means and proximate said vents for drawing air through said vents and creating a pressure increase in said housing means and in said boiler through said steam exit means; and a fill means including a one-way valve positioned in said fill means, connected to said boiler for providing fluid communication to said boiler and for substantially preventing fluid communication to said boiler when said air moving means creates a pressure increase in said boiler or when steam is generated in said boiler.

2. The facial treatment apparatus as in claim 1 further including means for controlling the temperature proximate said air vents.

3. The facial treatment apparatus as in claim 2 wherein said means for controlling the temperature includes a manually operated shutter means including a control knob adjustably arranged with respect to said vents for varying the effective size of said vents to air.

4. A facial treatment apparatus comprising:

housing means including a plurality of air vents and a steam exhaust means;

manually operated shutter means including a control knob adjustably arranged with respect to said vents for varying the effective size of said vents to air and for controlling the temperature of steam at said steam exhaust means;

steam generator means positioned in said housing and including a heater assembly and a boiler for generating steam, said boiler including a steam exit means for releasing steam from said boiler for combination with air in said housing to said steam exhaust means;

air moving means positioned in said housing and proximate said vents for drawing air through said vents and creating a pressure increase in said housing and in said boiler through said steam exit means; and fill means, including a one-way valve means positioned in said fill means, connected to said boiler for providing fluid communication to said boiler and for substantially preventing fluid communication to said boiler when said air moving means is creating a pressure increase in said boiler or when steam is generated in said boiler.

5. The apparatus as in claim 4 wherein said steam exit means includes a flexible hose coupled to said housing means at a first end thereof and to a personal care attachment at a second end thereof.

6. The apparatus as in claim 4 wherein said shutter means includes an electrical on-off switch means for said heater assembly, the state of said switch means being controllable by positioning said control knob.

7. The apparatus as in claim 6 wherein said shutter means includes an air control door in a sliding relationship with said vents.

8. The apparatus as in claim 7 further including means coupled to said air control door for preventing fluid communication through said drain means when said control knob is in an "on" position.

9. The apparatus as in claim 8 wherein said drain means includes a duck bill valve.

10. The apparatus as in claim 4 wherein said one-way valve means is an umbrella valve.

11. The apparatus as in claim 4 wherein said air moving means includes an axial fan.

12. The apparatus as in claim 6 further including a drain means from said boiler to the outside of said housing means for providing overfill protection when said control knob is in an "off" position.

* * * * *